US010787345B2

(12) United States Patent
Okamoto et al.

(10) Patent No.: US 10,787,345 B2
(45) Date of Patent: Sep. 29, 2020

(54) CRANE

(71) Applicant: TADANO LTD., Kagawa (JP)

(72) Inventors: Toshihiko Okamoto, Kagawa (JP); Yasuhiro Maeda, Kagawa (JP); Naoto Kawabuchi, Kagawa (JP)

(73) Assignee: TADANO LTD., Kagawa (JP)

( * ) Notice: Subject to any disclaimer, the term of this patent is extended or adjusted under 35 U.S.C. 154(b) by 37 days.

(21) Appl. No.: 16/088,528

(22) PCT Filed: Apr. 7, 2017

(86) PCT No.: PCT/JP2017/014541
§ 371 (c)(1),
(2) Date: Sep. 26, 2018

(87) PCT Pub. No.: WO2017/175862
PCT Pub. Date: Oct. 12, 2017

(65) Prior Publication Data

US 2019/0106300 A1 Apr. 11, 2019

(30) Foreign Application Priority Data

Apr. 7, 2016 (JP) ..... 2016-077669

(51) Int. Cl.
*F15B 15/00* (2006.01)
*B66C 13/20* (2006.01)
(Continued)

(52) U.S. Cl.
CPC ..... *B66C 13/20* (2013.01); *B66C 15/00* (2013.01); *B66C 23/82* (2013.01); *F15B 11/028* (2013.01);
(Continued)

(58) Field of Classification Search
CPC ..... F15B 2211/8636; F15B 2211/87; F15B 2211/8755
See application file for complete search history.

(56) References Cited

U.S. PATENT DOCUMENTS 7,290,977 B2 * 11/2007 Albright ..... E02F 3/3627 37/468
2013/0276516 A1 * 10/2013 Tabor ..... G01M 99/008 73/37
2014/0360349 A1 * 12/2014 De Gier ..... F15B 15/149 91/166

FOREIGN PATENT DOCUMENTS

JP 2014-163464 A 9/2014

OTHER PUBLICATIONS

Jul. 11, 2017, International Search Report issued for related PCT application No. PCT/JP2017/014541.
(Continued)

*Primary Examiner* — F Daniel Lopez
(74) *Attorney, Agent, or Firm* — Paratus Law Group, PLLC

(57) ABSTRACT

A crane is disclosed, the crane includes detachable hydraulic cylinder including a head side oil chamber and a rod side oil chamber both to be connected to a control valve through a joint, in which a head side hydraulic detecting section and a rod side hydraulic detecting section are each provided to the hydraulic cylinder, and a connection state between the hydraulic cylinder and the control valve is determined based on a head side hydraulic pressure and a rod side hydraulic pressure in a period until a predetermined time elapses after supply of electric power to the head side hydraulic detecting section and the rod side hydraulic detecting section is started and an operation tool for hydraulic cylinder switches the control valve to a state of supplying hydraulic fluid to the hydraulic cylinder.

4 Claims, 6 Drawing Sheets

(51) Int. Cl.

| | |
|---|---|
| ***F15B 20/00*** | (2006.01) |
| ***F15B 11/028*** | (2006.01) |
| ***B66C 15/00*** | (2006.01) |
| ***B66C 23/82*** | (2006.01) |
| ***F15B 15/14*** | (2006.01) |

(52) U.S. Cl.
CPC ..... *F15B 15/149* (2013.01); *F15B 20/00* (2013.01); *B66C 2700/0371* (2013.01); *B66C 2700/067* (2013.01); *F15B 2211/8636* (2013.01); *F15B 2211/8755* (2013.01)

(56) References Cited

OTHER PUBLICATIONS

Jul. 11, 2017, International Search Opinion issued for related PCT application No. PCT/JP2017/014541.

* cited by examiner

CRANE

CROSS REFERENCE TO PRIOR APPLICATION

This application is a National Stage Patent Application of PCT International Patent Application No. PCT/JP2017/014541 (filed on Apr. 7, 2017) under 35 U.S.C. § 371, which claims priority to Japanese Patent Application No. 2016-077669 (filed on Apr. 7, 2016), which are all hereby incorporated by reference in their entirety.

TECHNICAL FIELD

The present invention relates to a crane, particularly to a mobile crane with a detachable derricking hydraulic cylinder.

BACKGROUND ART

There has conventionally been known a mobile crane provided with a swivel base turnable by a hydraulic motor or the like on the frame of a vehicle and with a crane apparatus made up of a telescoping boom, a main winch, a sub-winch, a cabin, and the like on the swivel base. For some cranes, during travelling on a public road, the telescoping boom and like components need to be detached from the swivel base according to a weight limitation or the like. In a hydraulic circuit of a crane with a detachable telescoping boom, the associated hydraulic actuator is also configured to be detachable in addition to the telescoping boom, and thus hydraulic piping connected to the actuator and hydraulic piping connected to a hydraulic pump provided in the vehicle are connected to each other through a joint. In this way, for the crane, a given hydraulic actuator can easily be detached from the hydraulic circuit together with the telescoping boom.

In the hydraulic circuit of the crane with such a configuration, when hydraulic fluid is supplied from a supply-side oil passage while a joint of a return-side oil passage is disconnected, the hydraulic fluid supplied to the hydraulic actuator cannot return from the hydraulic actuator to a hydraulic tank. Consequently, the hydraulic pressure increases with supply of hydraulic fluid in the hydraulic circuit; thus, precaution is made to avoid breakage and oil leakage in the hydraulic actuator by providing a relief valve for releasing hydraulic pressure at a predetermined pressure (relief pressure). However, when the allowable hydraulic pressure of the hydraulic actuator is lower than such a predetermined pressure, even if the relief valve releases hydraulic fluid at the predetermined pressure, the hydraulic actuator is subjected to a hydraulic pressure higher than the allowable hydraulic pressure. For this reason, a known hydraulic circuit is provided with a multi-stage relief valve to change the relief pressure between a low pressure and a high pressure depending on the discharge pressure of the hydraulic pump. An example is described in PTL 1.

The hydraulic circuit described in PTL 1 is configured to determine that the return-side joint is connected when the discharge pressure of the hydraulic pump is below a predetermined value while the operating oil is circulated, and to switch the relief pressure of the multi stage relief valve from the low pressure to the high pressure. Thus, a hydraulic pressure higher than the relief pressure of the low pressure is not applied to the hydraulic circuit until the return-side joint is determined to be connected. However, in the technique described in PTL 1, the hydraulic pressure of the hydraulic circuit goes higher than the predetermined pressure of the relief valve when the discharge of the hydraulic pump exceeds the allowable relief flow rate of the relief valve. Moreover, when the hydraulic actuator is a hydraulic cylinder, because of the structure, the hydraulic pressure in a rod side oil chamber is amplified due to the hydraulic pressure in a head side oil chamber. In other words, in the hydraulic circuit described in PTL 1, when control is made for maximizing the operating speed of the hydraulic actuator, the flow rate of the hydraulic fluid exceeds the allowable relief flow rate of the relief valve, so that the pressure of the head side oil chamber of the hydraulic cylinder may rise and the amplified hydraulic pressure may be applied to the rod side oil chamber.

CITATION LIST

Patent Literature

PTL 1
Japanese Patent Application Laid-Open No. 2014-163464

SUMMARY OF INVENTION

Technical Problem

An object of the present invention is to provide a crane capable of suppressing the supply of hydraulic fluid while in poor connection with a hydraulic circuit to protect the hydraulic cylinder.

Solution to Problem

A crane according to the present invention includes a detachable hydraulic cylinder including a head side oil chamber and a rod side oil chamber both to be connected to a control valve through a joint, in which a head side hydraulic detecting section and a rod side hydraulic detecting section are each provided to the hydraulic cylinder, and when a rod side hydraulic pressure becomes greater than or equal to a head side hydraulic pressure by the time when a predetermined time elapses after supply of electric power to the head side hydraulic detecting section and the rod side hydraulic detecting section is started and the control valve is switched to a state of supplying hydraulic fluid to the head side oil chamber, it is determined that the rod side oil chamber and the control valve are not connected to each other through the joint.

In the crane according to the present invention, when power supply to the head side hydraulic detecting section and the rod side hydraulic detecting section is started and the control valve is switched to a state of supplying hydraulic fluid to the head side oil chamber, regardless of the amount of operation of the operation tool for hydraulic cylinder, preferably, the behavior of the control valve is limited such that the amount of hydraulic fluid supplied to the head side oil chamber is less than or equal to a predetermined value by the time when the predetermined time elapses.

In the crane according to the present invention, when power supply to the head side hydraulic detecting section and the rod side hydraulic detecting section is started and the control valve is switched to a state of supplying hydraulic fluid to the head side oil chamber, regardless of the amount of operation of the operation tool for hydraulic cylinder, preferably, the behavior of the control valve is limited such that the pressure of hydraulic fluid supplied to the head side oil chamber is less than or equal to a predetermined value by the time when the predetermined time elapses.

The crane according to the present invention further includes an informing section, in which, when it is determined that the rod side oil chamber and the control valve are not connected to each other, preferably, the informing section informs of a poor connection between the rod side oil chamber and the control valve.

In the crane according to the present invention, when it is determined that the rod side oil chamber and the control valve are not connected to each other, preferably, the control valve is switched to a state of not supplying hydraulic fluid to the head side oil chamber.

Advantageous Effects of Invention

In the crane of the present invention, the connection state of a return side joint providing a connection between the rod side oil chamber and the control valve is determined according to the states of the hydraulic pressures of the rod side oil chamber and head side oil chamber of the hydraulic cylinder. Thus, the actuation of the hydraulic cylinder in poor connection with the hydraulic circuit is suppressed, thereby protecting the hydraulic cylinder.

In the crane of the present invention, the increase rates of the hydraulic pressures of the rod side oil chamber and head side oil chamber in the hydraulic cylinder are suppressed, thereby preventing the application of an excessive hydraulic pressure to the hydraulic cylinder due to the operation by the operator. Thus, the actuation of the hydraulic cylinder in poor connection with the hydraulic circuit is suppressed, thereby protecting the hydraulic cylinder, In the crane of the present invention, the operator is made recognize a poor connection of the hydraulic cylinder with the hydraulic circuit. Thus, the actuation of the hydraulic cylinder in poor connection with the hydraulic circuit is suppressed, thereby protecting the hydraulic cylinder.

In the crane of the present invention, regardless of whether the operator recognizes a poor connection of the hydraulic cylinder with the hydraulic circuit, supply of hydraulic fluid to the hydraulic cylinder is forcibly stopped. Thus, the supply of hydraulic fluid in poor connection with the hydraulic circuit is suppressed, thereby protecting the hydraulic cylinder.

DESCRIPTION OF EMBODIMENTS

Crane 1 according to one embodiment of a crane will now be described with reference to FIGS. 1 to 4.

Figure 1:
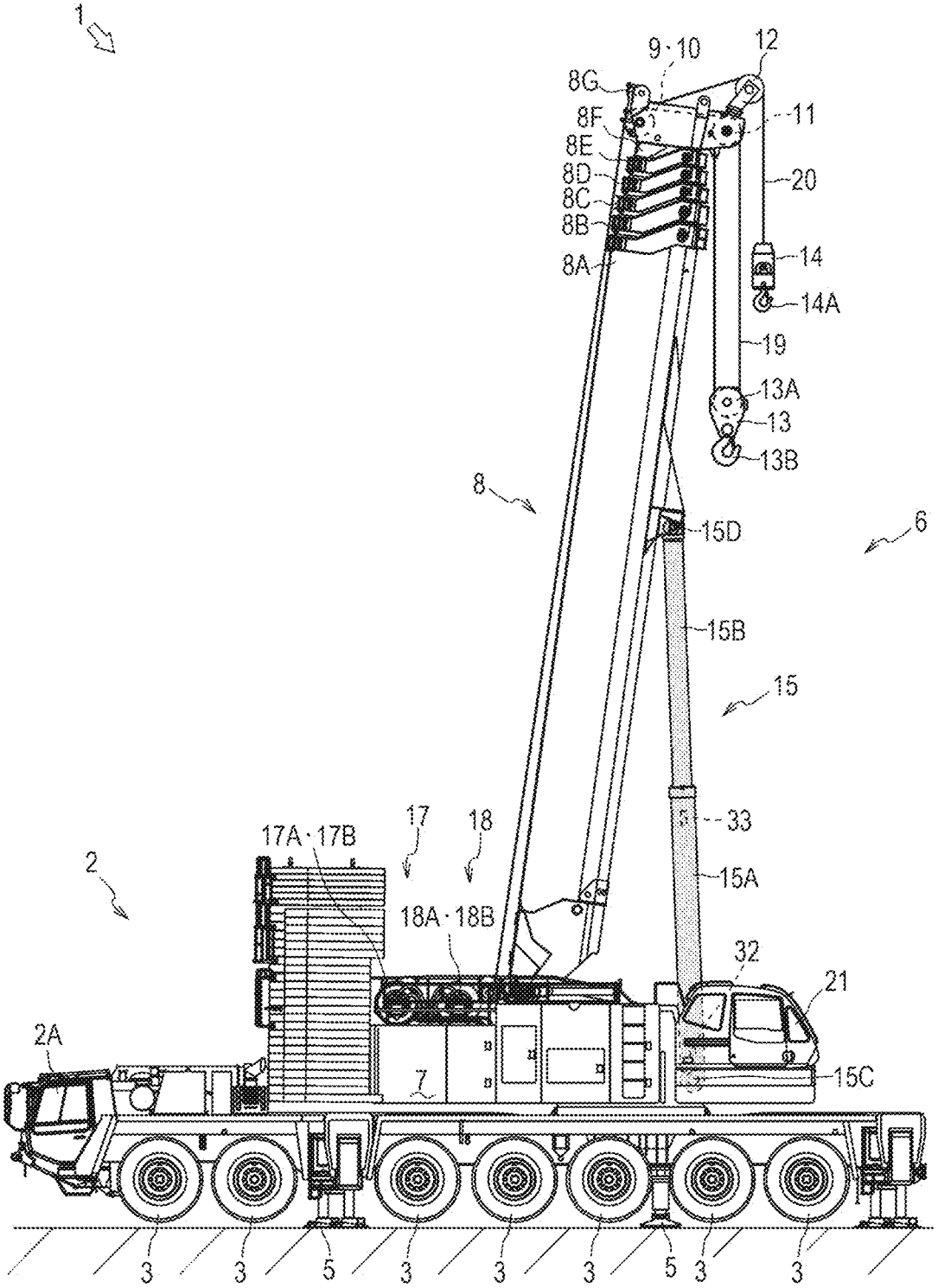
FIG. 1 is a side view showing the entire configuration of a crane according to one embodiment of the present invention.

As shown in FIG. 1, crane 1 is a mobile crane relocatable to an unspecified location. Crane 1 includes vehicle 2 and crane apparatus 6.

Vehicle 2 carries crane apparatus 6. Vehicle 2 has operator's cab 2A and a plurality of wheels 3 and is mounted with engine 4 which serves as a power source (see FIG. 4). Vehicle 2 is configured to transmit the driving force of engine 4 to the plurality of wheels 3 according to the operation from operator's cab 2A to travel. Vehicle 2 is provided with outrigger 5. Outrigger 5 is made up of an overhang beam which can be extended by hydraulic pressure in the width direction of vehicle 2 toward both sides and hydraulic jack cylinders which can be extended in a direction perpendicular to the ground. In vehicle 2, outrigger 5 can be extended in the width direction of vehicle 2 and the workable range of crane 1 can be extended by grounding the jack cylinders.

Crane apparatus 6 lifts an object to be carried, with a wire rope. Crane apparatus 6 includes swivel base 7, telescoping boom 8, main hook block 13, sub-hook block 14, derricking cylinder 15, main winch 17, sub-winch 18, main wire rope 19, sub-wire rope 20, cabin 21, and safety apparatus 23.

Swivel base 7 makes crane apparatus 6 rotatable. Swivel base 7 is provided on the frame of vehicle 2 through an annular bearing. The annular bearing is disposed such that its rotation axis can be perpendicular to the installation surface of vehicle 2. Swivel base 7 is configured to be rotatable about a rotation axis that passes the center of the annular bearing. Moreover, swivel base 7 is configured to be rotated through a hydraulic rotation motor which is not shown in the drawing.

Telescoping boom 8 serving as a boom supports a wire rope so that an object to be carried can be lifted. Telescoping boom 8 is made up of a plurality of boom members: base boom member 8A, second boom member 8B, third boom member 8C, fourth boom member 8D, fifth boom member 8E, and top boom member 8F. The boom members are hollow cylinders with polygonal cross-sections similar to each other. The boom members have such sizes that they can be inserted in one another in descending order of cross sectional area, in other words, top boom member 8F with the smallest cross sectional area has such a size that it can be inserted in fifth boom member 8E with a cross sectional area following that of top boom member 8F. Fifth boom member 8E has such a size that it can be inserted in fourth boom member 8D with a cross sectional area following that of fifth boom member 8E. In this manner, in telescoping boom 8, second boom member 8B, third boom member 8C, fourth boom member 8D, fifth boom member 8E, and top boom member 8F are nested in base boom member 8A, which has the largest cross sectional area, in descending order of cross sectional area.

Moreover, in telescoping boom 8, second boom member 8B, third boom member 8C, fourth boom member 8D, fifth boom member 8E, and top boom member 8F are configured to be movable in the axial direction of telescoping boom 8 with respect to base boom member 8A. In other words, telescoping boom 8 is configured to be telescopic by moving each boom member with a telescoping cylinder or the like not shown in the drawing. In telescoping boom 8, the base end of base boom member 8A is provided on swivel base 7 so that it is swingable. Thus, telescoping boom 8 is configured to be horizontally rotatable on the frame of vehicle 2. Further, telescoping boom 8 is configured to be swingable about the base end of base boom member 8A with respect to swivel base 7.

The distal end of top boom member 8F of telescoping boom 8 is provided with main guide sheave 9, sub-guide sheave 10, main sheave 11, and sub-sheave 12. Main guide sheave 9 around which main wire rope 19 is wound and sub-guide sheave 10 around which sub-wire rope 20 is wound are rotatably provided to the back surface of the distal end of top boom member 8F (the side surface of standing telescoping boom 8 in the swinging direction). Sub-sheave 12 around which sub-wire rope 20 is wound and a plurality of main sheaves 11 around which main wire rope 19 is wound are rotatably provided, in this order from the distal end side, to the ventral surface of the distal end of top boom member 8F (the side surface of standing telescoping boom 8 in the direction opposite to the swinging direction). Moreover, jib support unit 8G is provided at the distal end of top boom member 8F.

An object to be carried is suspended on main hook block 13. A plurality of hook sheaves 13A around which main wire rope 19 is wound, and main hook 13B which suspends an object to be carried are provided to main hook block 13. An object to be carried is suspended on sub-hook block 14. Sub-hook block 14 is provided with sub-hook 14A on which an object to be carried is suspended.

Derricking cylinder 15 (gray portion) makes telescoping boom 8 stand and lie down and holds the attitude of telescoping boom 8. Derricking cylinder 15 is composed of a hydraulic cylinder which is made up of cylinder unit 15A and rod unit 15B. In derricking cylinder 15, an end of cylinder unit 15A is swingably coupled to swivel base 7 through cylinder-side swinging shaft 15C, and an end of rod unit 15B is swingably coupled to base boom member 8A of telescoping boom 8 through rod-side swinging shaft 15D. In derricking cylinder 15, head side oil chamber 15E (see FIG. 4) is connected to derricking direct-acting selector valve 28 (see FIG. 4) of derricking hydraulic circuit 24 (see FIG. 4) through derricking one side oil passage 29 (see FIG. 4), and rod side oil chamber 15F (see FIG. 4) is connected to derricking direct-acting selector valve 28 through derricking other side oil passage 30 (see FIG. 4). Moreover, derricking cylinder 15 includes head side hydraulic sensor 32 which is a head side hydraulic detecting section for detecting the value of hydraulic pressure Ph which is the head side hydraulic pressure of head side oil chamber 15E, and rod side hydraulic sensor 33 which is a rod side hydraulic detecting section for detecting the value of hydraulic pressure Pr which is the rod side hydraulic pressure of rod side oil chamber 15E Head side hydraulic sensor 32 and rod side hydraulic sensor 33 are connected to control apparatus 34 which will be described below (see FIGS. 4 and 5).

In derricking cylinder 15, the direction of movement of rod unit 15B is changed by selective supply of hydraulic fluid to head side oil chamber 15E and rod side oil chamber 15F through derricking direct-acting selector valve 28. Thus, in derricking cylinder 15, hydraulic fluid is supplied to head side oil chamber 15E in such a manner that rod unit 15B is pushed out from cylinder unit 15A so that base boom member 8A stands, and hydraulic fluid is supplied to rod side oil chamber 15F in such a manner that rod unit 15B is pushed back to cylinder unit 15A so that base boom member 8A lies down.

Figure 2:
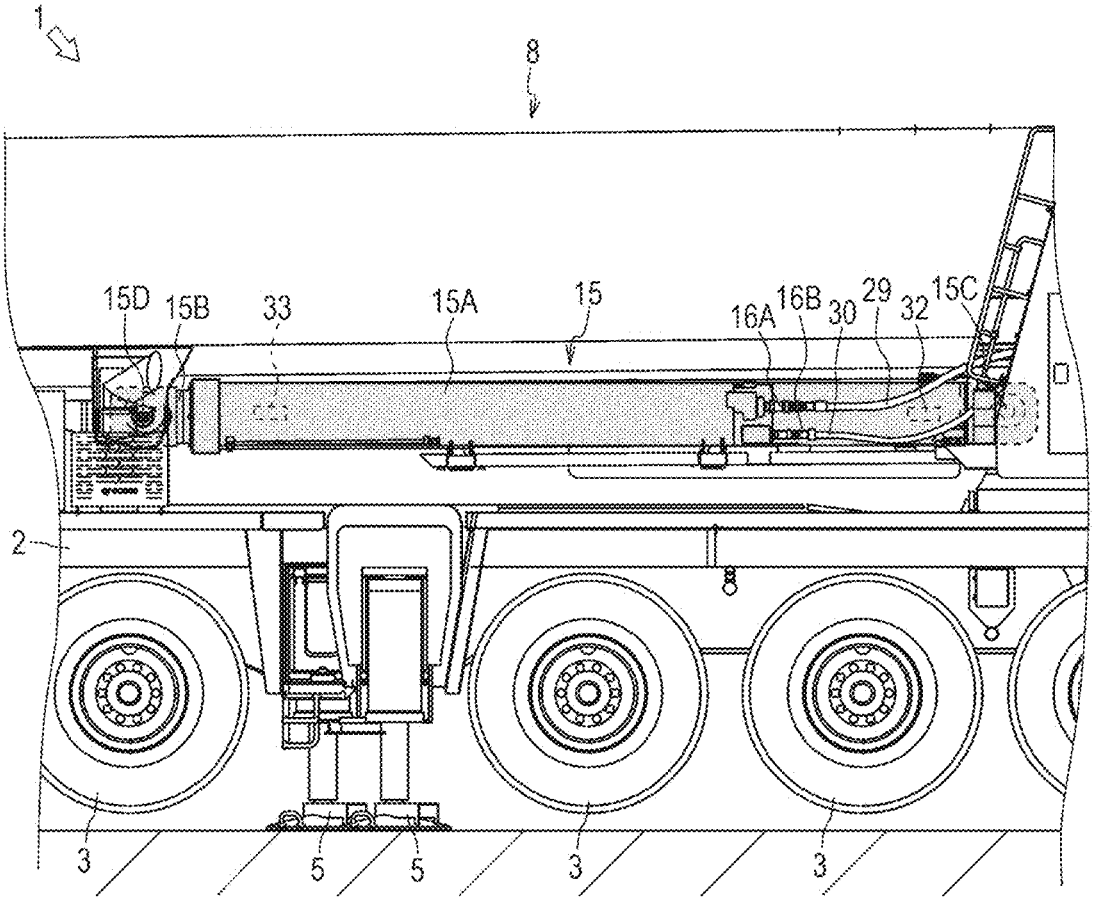
FIG. 2 is a partially enlarged view showing a derricking cylinder part of a crane according to one embodiment of the present invention.

As shown in FIG. 2, one side joint 16A, which divides derricking one side oil passage 29 into a cylinder side part and a switching valve side part, is provided in the middle of derricking one side oil passage 29 for connection between head side oil chamber 15E of derricking cylinder 15 (gray portion) and derricking direct-acting selector valve 28. Similarly, other side joint 16B, which divides derricking other side oil passage 30 into a cylinder side part and a switching valve side part, is provided in the middle of derricking other side oil passage 30 for connection between rod side oil chamber 15F of derricking cylinder 15 and derricking direct-acting selector valve 28. One side joint 16A and other side joint 16B are configured to close the ends of separated oil passages. Such a configuration prevents hydraulic fluid from flowing out from separated derricking one side oil passage 29 and derricking other side oil passage 30. Further, in the middle of a communication line for connection between head side hydraulic sensor 32 and control apparatus 34, and between rod side hydraulic sensor 33 and control apparatus 34, connector 16C (see FIGS. 4 and 5), which divides the communication line into a sensor side part and a control apparatus 34 side part, is provided.

Derricking cylinder 15 is separated from swivel base 7 and telescoping boom 8 upon detachment of cylinder-side swinging shaft 15C and rod-side swinging shaft 15D. Derricking cylinder 15 is separated from derricking hydraulic circuit 24 (see FIG. 4) upon separation of one side joint 164 and other side joint 16B. Further, as for derricking cylinder 15, separation of connector 16C allows head side hydraulic sensor 32 and rod side hydraulic sensor 33 to be separated from control apparatus 34 (see FIGS. 4 and 5). Thus, derricking cylinder 15 is configured to be separable from swivel base 7, telescoping boom 8, derricking hydraulic circuit 24, and control apparatus 34.

As shown in FIG. 1, main winch 17 draws in (winds up) and draws out (winds down) main wire rope 19. Main winch 17 is configured such that main drum 17B around which main wire rope 19 is wound can be rotated through main hydraulic motor 17A. Main winch 17 is provided to swivel base 7 so that the rotation shaft of main drum 17B can he orthogonal to the telescoping direction of telescoping boom 8. As for main hydraulic motor 17A, the rotation direction is changed between one direction and the other direction by selective supply of hydraulic fluid to a draw-in side plunger (hereinafter simply referred to as "draw-in side part") and a draw-out side plunger (hereinafter simply referred to as "draw-out side part"). Thus, in main winch 17, hydraulic fluid is supplied such that main hydraulic motor 17A can rotate in one direction and main wire rope 19 wound around main drum 17B can thus be drawn out, and hydraulic fluid is supplied such that main hydraulic motor 17A can rotate in the other direction and main wire rope 19 can thus be drawn in while being wound around main drum 17B.

Sub-winch 18 draws (winds up) and draws out (winds down) sub-wire rope 20. Sub-winch 18 is configured such that sub-drum 18B around which sub-wire rope 20 is wound is rotated through sub hydraulic motor 18A. Sub-winch 18 is provided to swivel base 7 so that the rotation shaft of sub-drum 1813 can be orthogonal to the telescoping direction of telescoping boom 8. As for sub hydraulic motor 18A of sub-winch 18, the rotation direction is changed between one direction and the other direction by selective supply of hydraulic fluid to the draw-in side part and the draw-out side part. Thus, in sub-winch 18, hydraulic fluid is supplied such that sub hydraulic motor 18A can rotate in one direction and sub-wire rope 20 wound around sub-drum 18B can thus be drawn out, and hydraulic fluid is supplied such that sub hydraulic motor 18A can rotate in the other direction and sub-wire rope 20 can thus be drawn in while being wound around sub-drum 18B.

Main wire rope 19 is passed from main winch 17 to a plurality of main sheaves 11 and a plurality of hook sheaves 13A through main guide sheave 9 and wound around them. An end of main wire rope 19 is fixed to top boom member 8F. Further, sub-wire rope 20 from sub-winch 18 is connected to sub-hook block 14 through sub-guide sheave 10 and sub-sheave 12.

Figure 3:
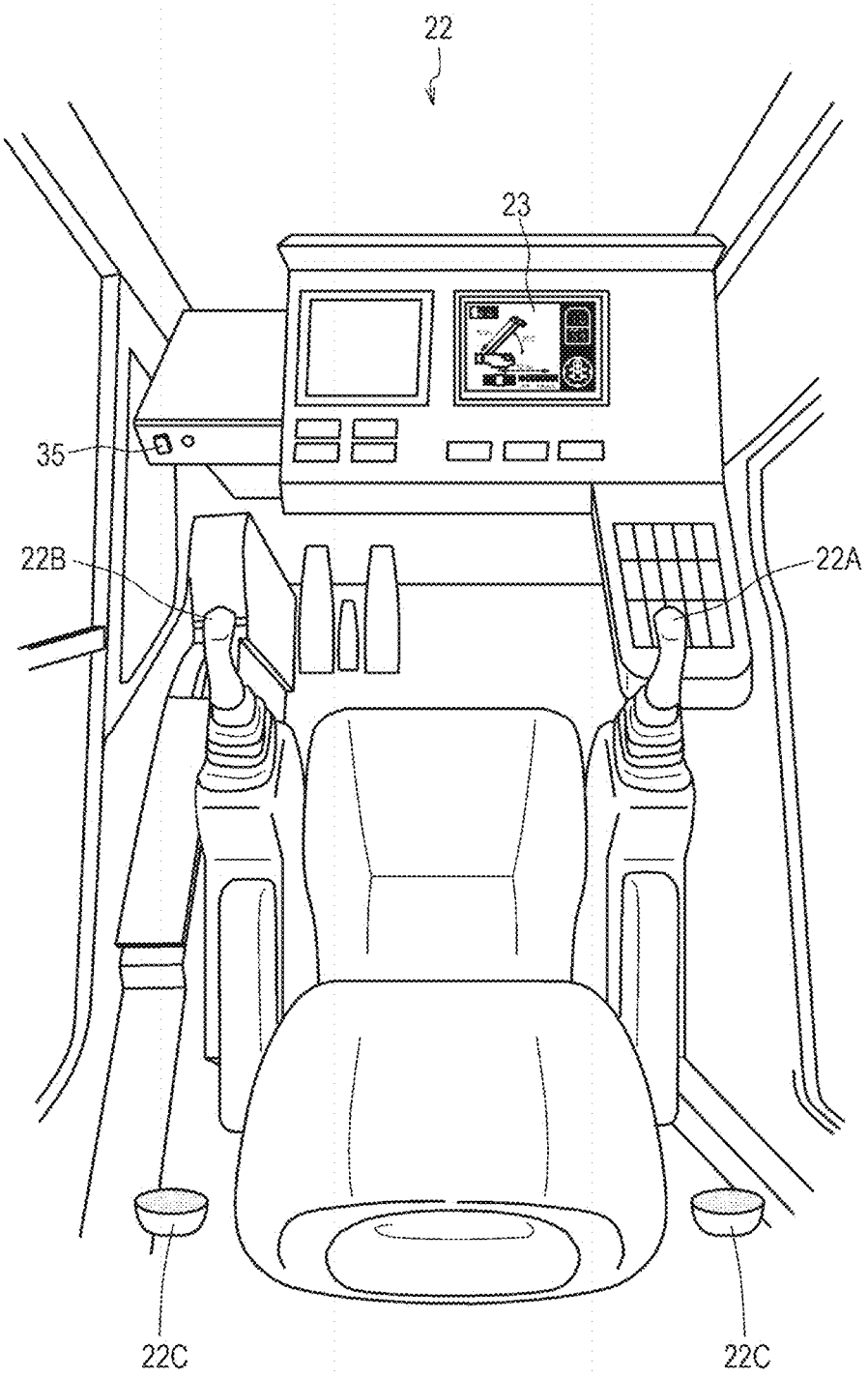
FIG. 3 is a diagram showing an operator's seat of the crane according to one embodiment of the present invention.

Cabin 21 covers operator's seat 22 (see FIG. 3). Cabin 21 is provided on a side of swivel base 7 adjacent to telescoping boom 8. Operator's seat 22 is provided in cabin 21.

As shown in FIG. 3, operator's seat 22 is provided rotation telescoping operation tool 22A for performing rotation operation for swivel base 7 and telescoping operation for telescoping boom 8, derricking operation tool 229 for performing draw-in and draw-out operation for main winch 17 and derricking operation for telescoping boom 8, alarm apparatus 22C serving as an informing section, safety apparatus 23 for inputting the work content or the like of crane 1, and power switch 35 for crane 1, for example.

Safety apparatus 23 is used to set the type of work showing the mode of use of telescoping boom 8, and the number of turns. Safety apparatus 23 is made up of a display monitor such as a touch panel. The safety apparatus 23 allows various settings to be made from the display screen of the display monitor and serves as an informing section informing the operator of a warning or an alarm.

In crane 1 with such a configuration, crane apparatus 6 can be moved to an arbitrary position by running vehicle 2. Moreover, in crane 1, the lifting height and operating radius of crane apparatus 6 can be increased by making telescoping boom 8 stand at an arbitrary derricking angle with derricking cylinder 15 and making telescoping boom 8 telescope to an arbitrary boom length or connecting a jib. Further, for crane 1, selection can be made between use of main winch 17 or use of sub-winch 18 according to the weight and the desired lifting rate of the object to be carried. Meanwhile, for crane 1, the allowable lifting load can be changed by changing the number of turns of main wire rope 19 according to the weight of the object to be carried.

Derricking hydraulic circuit 24 related to derricking cylinder 15 in crane 1 will be now described with reference to FIG. 4.

Figure 4:
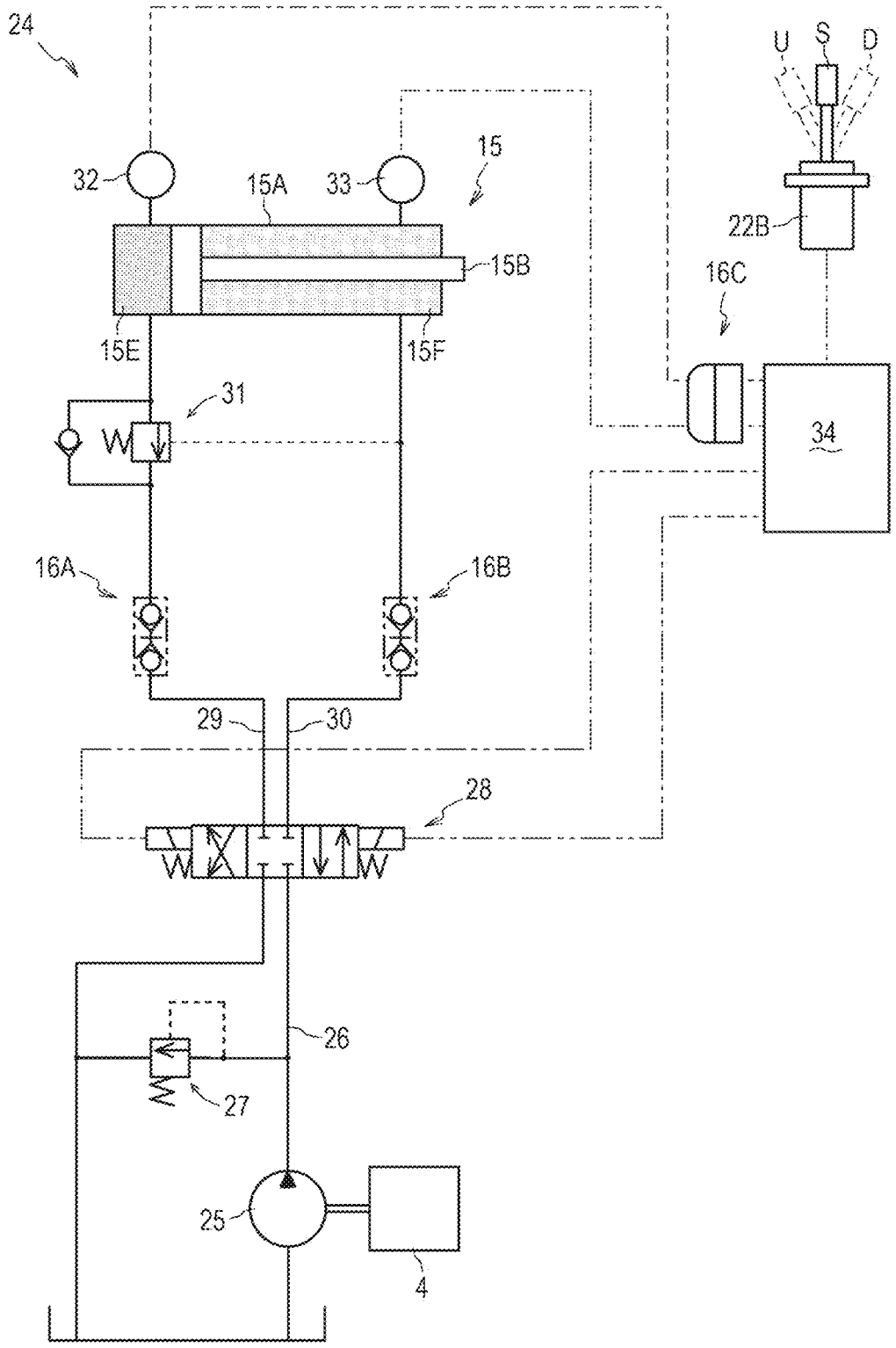
FIG. 4 is a diagram showing a hydraulic circuit for a derricking cylinder of the crane according to one embodiment of the present invention.

As shown in FIG. 4, derricking hydraulic circuit 24 actuates derricking cylinder 15. Derricking hydraulic circuit 24 includes derricking cylinder 15, one side joint 16A, other side joint 16B, derricking operation tool 22B, which is an operation tool for hydraulic cylinder, hydraulic pump 25, derricking direct-acting selector valve 28, derricking counter balance valve 31, head side hydraulic sensor 32, rod side hydraulic sensor 33, and control apparatus 34.

In derricking cylinder 15, head side oil chamber 15E (dark gray portion) connected to one port of derricking direct-acting selector valve 28 through derricking one side oil passage 29. Further, in derricking cylinder 15, rod side oil chamber 15F (light gray portion) is connected to the other port of derricking direct-acting selector valve 28 through derricking other side oil passage 30. In this case, derricking cylinder 15 is configured to be detachable from derricking direct-acting selector valve 28 through one side joint 16A. Similarly, derricking cylinder 15 is detachable from derricking direct-acting selector valve 28 through other side joint 16B. One side joint 16A and other side joint 16B are configured to block the passage of hydraulic fluid when derricking cylinder 15 is separated from derricking direct-acting selector valve 28. Such a configuration prevents hydraulic fluid from flowing out from derricking one side oil passage 29 and derricking other side oil passage 30 from which derricking cylinder 15 is separated.

Derricking operation tool 22B controls the behavior of derricking cylinder 15. Derricking operation tool 22B is configured to transmit a pump signal from the electromagnet of derricking direct-acting selector valve 28 to control apparatus 34. When located in neutral position S through operation, derricking operation tool 22B transmits a signal that instructs not to excite the electromagnet of derricking direct-acting selector valve 28. When located in standing position U through operation, derricking operation tool 22B transmits a signal that instructs to excite the electromagnet that opens one port of derricking direct-acting selector valve 28, to control apparatus 34. When located in lying position D through operation, derricking operation tool 22B transmits a signal that instructs to excite the electromagnet that opens the other port of derricking direct-acting selector valve 28, to control apparatus 34.

Hydraulic pump 25 discharges hydraulic fluid. Hydraulic pump 25 is driven by engine 4. Hydraulic fluid discharged from hydraulic pump 25 is supplied to derricking direct-acting selector valve 28. Discharged oil passage 26 of hydraulic pump 25 is provided with relief valve 27.

Derricking direct-acting selector valve 28 serving as a control valve switches the direction of hydraulic fluid supplied to derricking cylinder 15. The supply port of derricking direct-acting selector valve 28 is connected to hydraulic pump 25 through discharged oil passage 26. One port of derricking direct-acting selector valve 28 is connected to head side oil chamber 15E of derricking cylinder 15 through derricking one side oil passage 29. The other port of derricking direct-acting selector valve 28 is connected to rod side oil chamber 15F of derricking cylinder 15 through derricking other side oil passage 30. Further, derricking direct-acting selector valve 28 is connected to control apparatus 34.

In derricking direct-acting selector valve 28, when the electromagnet is not excited (derricking operation tool 22B is located in neutral position S through operation), derricking one side oil passage 29 and derricking other side oil passage 30 are closed. This keeps the position of rod unit 15B of derricking cylinder 15. In derricking direct-acting selector valve 28, when the electromagnet is excited such that one port can be opened (when derricking operation tool 22B is located in standing position U through operation), hydraulic fluid from hydraulic pump 25 is supplied to head side oil chamber 15E of derricking cylinder 15 through derricking one side oil passage 29. Thus, in derricking cylinder 15, rod unit 15B is pushed out from cylinder unit 15A so that telescoping boom 8 can stand. In derricking direct-acting selector valve 28, when the electromagnet is excited such that the other port can be opened (when derricking operation tool 22B is located in lying position D through operation), hydraulic fluid from hydraulic pump 25 is supplied to rod side oil chamber 15F of derricking cylinder 15 through derricking other side oil passage 30. Thus, in derricking cylinder 15, rod unit 15B is pushed back to cylinder unit 15A so that telescoping boom 8 can lie down. Although derricking direct-acting selector valve 28 is a control valve for controlling the flow rate of hydraulic fluid in this embodiment, this is not necessarily the case and it may be a pressure control valve for controlling the supply pressure.

Derricking counter balance valve 31 prevents rod unit 15B of derricking cylinder 15 from being pushed back by the load on telescoping boom 8. Derricking counter balance valve 31 is provided to derricking one side oil passage 29. Further, derricking counter balance valve 31 is configured such that the hydraulic pressure in derricking other side oil passage 30 is applied as pilot pressure. Derricking counter balance valve 31 always permits hydraulic fluid to flow into head side oil chamber 15E of derricking cylinder 15. On the other hand, derricking counter balance valve 31 permits the flow of hydraulic fluid to be discharged from head side oil chamber 15E of derricking cylinder 15 only when rod side oil chamber 15F of derricking cylinder 15 is supplied with hydraulic fluid.

Head side hydraulic sensor 32 and rod side hydraulic sensor 33 detect values of hydraulic pressure. Head side hydraulic sensor 32 is provided in head side oil chamber 15E of derricking cylinder 15, and is configured to detect hydraulic pressure Ph in head side oil chamber 15E. Rod side hydraulic sensor 33 is provided in rod side oil chamber 15F of derricking cylinder 15, and is configured to detect hydraulic pressure Pr in rod side oil chamber 15F. Head side hydraulic sensor 32 and rod side hydraulic sensor 33 are connected to control apparatus 34 through connector 16C. In other words, head side hydraulic sensor 32 and rod side hydraulic sensor 33 are configured to be detachable from control apparatus 34 through connector 16C. Further, head side hydraulic sensor 32 and rod side hydraulic sensor 33 are supplied with electric power from control apparatus 34.

Crane 1 including derricking hydraulic circuit 24 with such a configuration controls derricking direct-acting selector valve 28 according to a signal from derricking operation tool 22B, thereby changing the flow of hydraulic fluid supplied to derricking cylinder 15. Thus, for crane 1, telescoping boom 8 can be freely made stand and lie down with derricking cylinder 15 by the operation of derricking operation tool 22B.

Next, with reference to FIGS. 5 to 7, the configuration of control apparatus 34 of crane 1 with the above-described configuration, determination of a poor connection of derricking cylinder 15 through control apparatus 34, and protection control of derricking cylinder 15 will be described.

Figure 5:
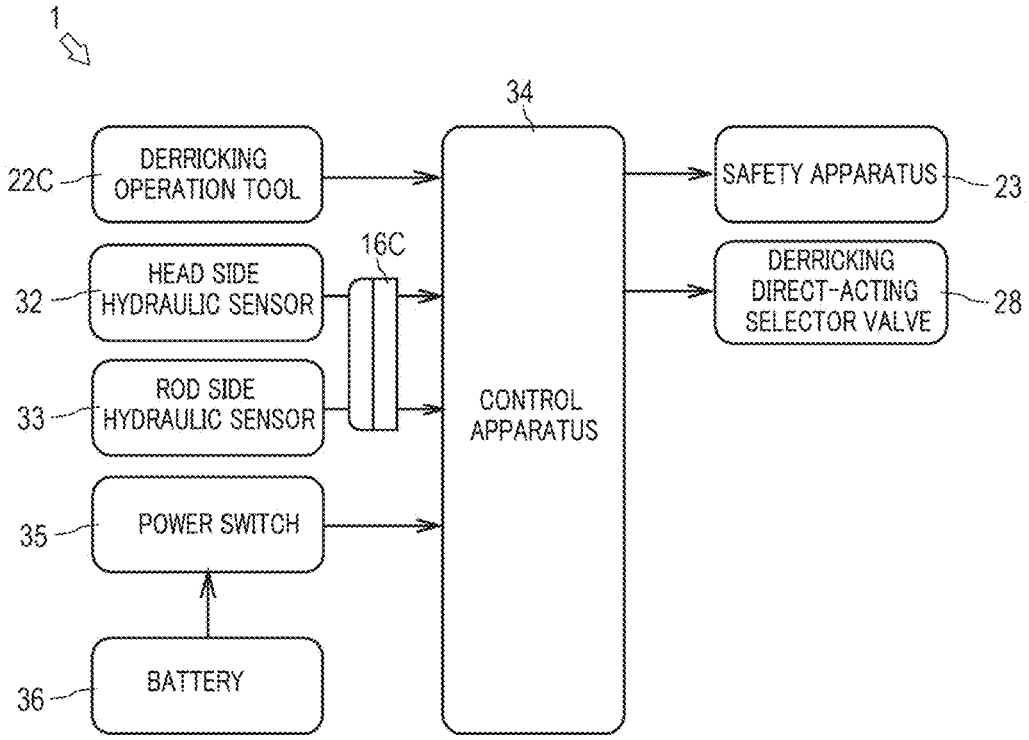
FIG. 5 is a diagram showing a configuration of a control apparatus of the crane according to one embodiment of the present invention.

As shown in FIG. 5, control apparatus 34 controls the operation of derricking cylinder 15. Substantively, control apparatus 34 may have a configuration in which a CPU, a ROM, a RAM, and an HDD, for example, are connected through a bus, or may include a one-chip LSI, or the like. Control apparatus 34 stores various programs or data for controlling the operation of derricking cylinder 15.

Control apparatus 34 is connected to derricking operation tool 22B and can obtain a signal indicating an operational position from derricking operation tool 22B.

Control apparatus 34 is connected to alarm apparatus 22C and can issue an alarm through alarm apparatus 22C.

Control apparatus 34 is connected to safety apparatus 23 and can obtain information such as the type of work input from safety apparatus 23 and allows safety apparatus 23 to display various information, an alarm, and the like on the screen.

Control apparatus 34 is connected to derricking direct-acting selector valve 28 and can selectively excite the electromagnet of derricking direct-acting selector valve 28 based on the derricking signal obtained from derricking operation tool 22B, thereby switching the position of the spool of derricking direct-acting selector valve 28.

Control apparatus 34 is connected to head side hydraulic sensor 32 and rod side hydraulic sensor 33 and can obtain hydraulic pressure Ph value of head side oil chamber 15E of derricking cylinder 15 from head side hydraulic sensor 32, and hydraulic pressure Pr value of rod side oil chamber 15F of derricking cylinder 15 from rod side hydraulic sensor 33. Further, control apparatus 34 is connected to head side hydraulic sensor 32 and rod side hydraulic sensor 33 through connector 16C.

Control apparatus 34 is connected to battery 36 via power switch 35 of crane 1 and can be supplied with electric power from battery 36 by turning on power switch 35 while electric power is supplied to head side hydraulic sensor 32 and rod side hydraulic sensor 33.

Figure 6:
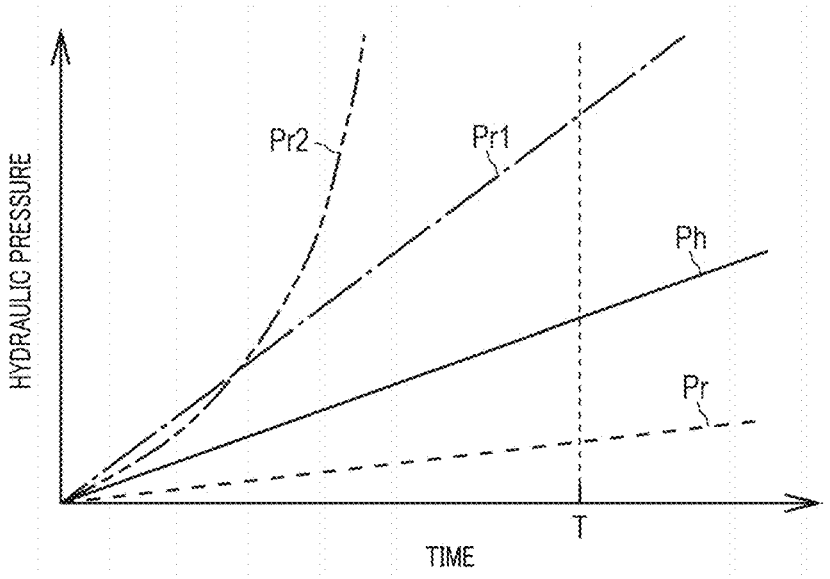
FIG. 6 is a graph showing the relationship between the pressure of the head side oil chamber of the derricking cylinder and the pressure of the rod side oil chamber in the crane according to one embodiment of the present invention.
Figure 7:
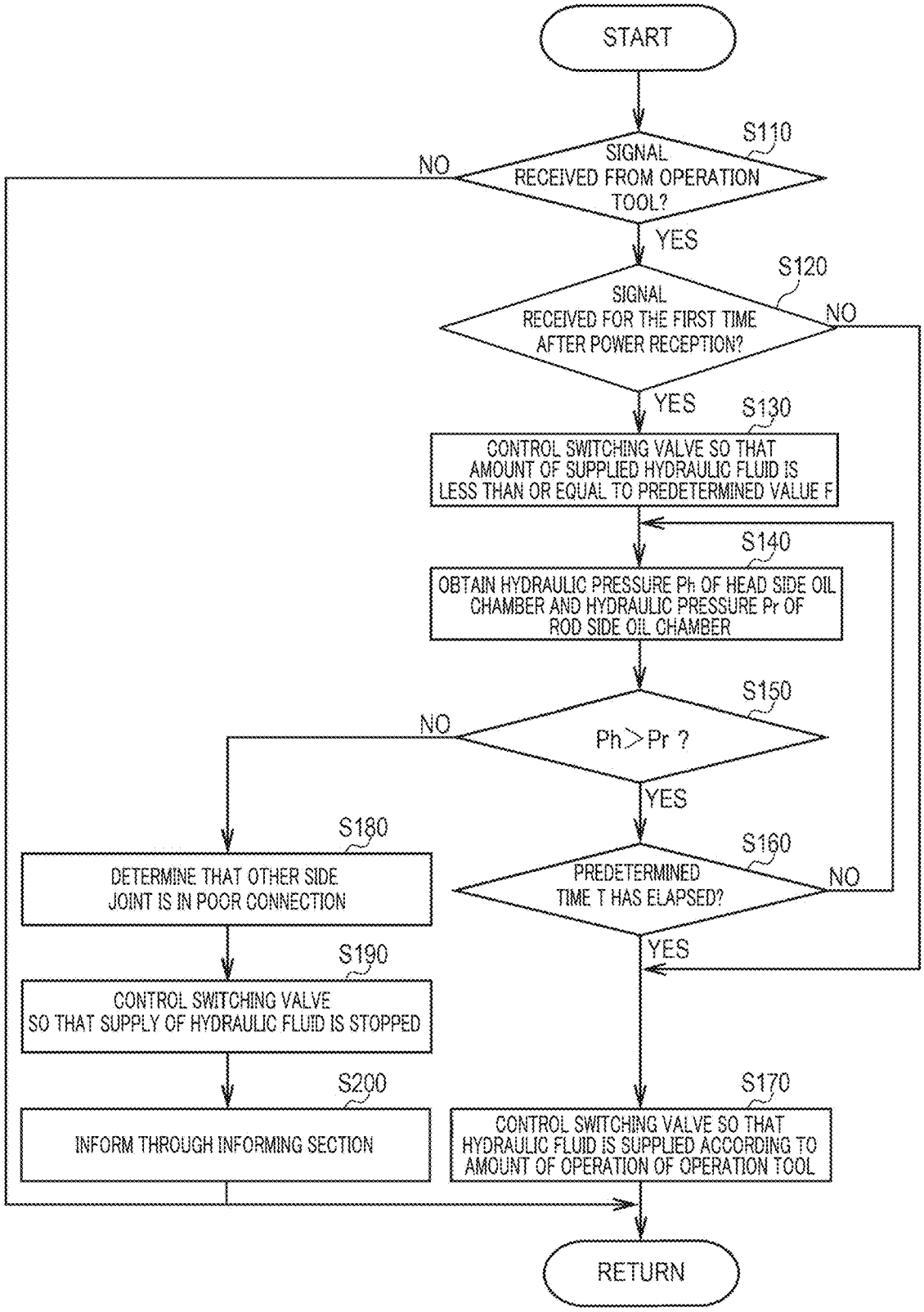
FIG. 7 is a flow chart showing a control mode of derricking cylinder's poor connection determination control and derricking cylinder protection control in the crane according to one embodiment of the present invention.

With reference to FIGS. 5 to 7, determination control of a poor connection of derricking cylinder 15 of crane 1 with the above-described configuration, and protection control of derricking cylinder 15 will now be described. In this embodiment, in crane 1, derricking cylinder 15 is assembled to swivel base 7 and telescoping boom 8.

As shown in FIG. 5, control apparatus 34 of crane 1 is supplied with electric power from battery 36 by turning on power switch 35. When power is supplied from battery 36, control apparatus 34 starts to supply electric power to head side hydraulic sensor 32 and rod side hydraulic sensor 33. In other words, control apparatus 34 obtains hydraulic pressure Ph of head side oil chamber 15E at a predetermined interval from head side hydraulic sensor 32 and obtains hydraulic pressure Pr of rod side oil chamber 15F at a predetermined interval from rod side hydraulic sensor 33. Receiving a derricking signal (a control signal for derricking direct-acting selector valve 28) from derricking operation tool 22B for the first time after the initiation of supply of electric power to head side hydraulic sensor 32 and rod side hydraulic sensor 33, control apparatus 34 controls derricking direct-acting selector valve 28 so that the amount of hydraulic fluid supplied to derricking cylinder 15 can be less than or equal to predetermined value F regardless of the amount of operation of derricking operation tool 22B.

As shown in FIG. 6, when hydraulic pressure Pr of rod side oil chamber 15F obtained by the time when predetermined time T elapses is greater than or equal to hydraulic pressure Ph of head side oil chamber 15E (e.g., hydraulic pressure Pr1 or hydraulic pressure Pr2 in FIG. 6), control apparatus 34 determines that rod side oil chamber 15F (light gray portion) of derricking cylinder 15 and derricking direct-acting selector valve 28 are not properly connected to each other through other side joint 16B. Control apparatus 34 displays a warning on safety apparatus 23, which is a joint informing section, and issues an alarm from alarm apparatus 22C. Further, control apparatus 34 controls derricking direct-acting selector valve 28 so that the supply of hydraulic fluid to derricking cylinder 15 is stopped.

Next, with reference to FIG. 7, determination control of a poor connection of derricking cylinder 15 and protection control of derricking cylinder 15 through control apparatus 34 of crane 1 will be described. In this embodiment, it is assumed that control apparatus 34 of crane 1 starts to be supplied with electric power from battery 36 by operation of power switch 35 after assembling derricking cylinder 15.

As shown in FIG. 7, in Step S110, control apparatus 34 determines whether or not the control signal of derricking direct-acting selector valve 28 has been received from derricking operation tool 22B.

Consequently, if the control signal of derricking direct-acting selector valve 28 has been received from derricking operation tool 22B, control apparatus 34 advances the process to Step S120.

In contrast, if the control signal of derricking direct-acting selector valve 28 has not been received from derricking operation tool 22B, control apparatus 34 advances the process to Step S110.

In Step S120, control apparatus 34 determines whether or not the control signal of derricking direct-acting selector valve 28 has been received from derricking operation tool 22B for the first time after receiving electric power from battery 36.

Consequently, if the control signal of derricking direct-acting selector valve 28 has been received from derricking operation tool 22B for the first time after receiving electric power from battery 36, control apparatus 34 advances the process to Step S130.

In contrast, if the control signal of derricking direct-acting selector valve 28 has already been received from derricking operation tool 22B after receiving electric power from battery 36, control apparatus 34 advances the process to Step S170.

In Step S130, control apparatus 34 controls derricking direct-acting selector valve 28 so that the amount of hydraulic fluid supplied to derricking cylinder 15 is less than equal to predetermined value F, and advances the process to Step S140.

In Step S140, control apparatus 34 obtains hydraulic pressure Ph of head side oil chamber 15E and hydraulic pressure Pr of rod side oil chamber 15F and advances the process to Step S150.

In Step S150, control apparatus 34 determines whether or not obtained hydraulic pressure Ph of head side oil chamber 15E is greater than hydraulic pressure Pr of rod side oil chamber 15F.

Consequently, if obtained hydraulic pressure Ph of head side oil chamber 15E is determined to be greater than hydraulic pressure Pr of rod side oil chamber 15F, control apparatus 34 advances the process to Step S160.

In contrast, if obtained hydraulic pressure Ph of head side oil chamber 15E is determined to be not greater than hydraulic pressure Pr of rod side oil chamber 15F, that is, if hydraulic pressure Pr of rod side oil chamber 15F is greater than or equal to hydraulic pressure Ph of head side oil chamber 15E, control apparatus 34 advances the process to Step S180.

In Step S160, control apparatus 34 determines whether or not predetermined time T has elapsed after the initiation of control of derricking direct-acting selector valve 28 so that the amount of hydraulic fluid supplied to derricking cylinder 15 is less than or equal to predetermined value F.

Consequently, if it is determined that predetermined time T has elapsed after the initiation of control of derricking direct-acting selector valve 28 so that the amount of hydraulic fluid supplied to derricking cylinder 15 is less than or equal to predetermined value F, control apparatus 34 advances the process to Step S170.

In contrast, if it is determined that predetermined time has not elapsed after the initiation of control of derricking direct-acting selector valve 28 so that the amount of hydraulic fluid supplied to derricking cylinder 15 is less than or equal to predetermined value F, control apparatus 34 advances the process to Step S140.

In Step S170, control apparatus 34 controls derricking direct-acting selector valve 28 so that hydraulic fluid supplied to derricking cylinder 15 is supplied according to the amount of operation of derricking operation tool 22B, and advances the process to Step S110.

In Step S180, control apparatus 34 determines that other side joint 16B has a poor connection, and advances the process to Step S190.

In Step S190, control apparatus 34 controls derricking direct-acting selector valve 28 so that supply of hydraulic fluid to derricking cylinder 15 stops, and advances the process to Step S200.

In Step S200, control apparatus 34 informs the operator of an alarm saying that other side joint 16B has a poor connection through safety apparatus 23, which is an informing section, and further informs the operator through alarm apparatus 22C, and advances the process to Step S110.

With this configuration, in crane 1, when electric power is supplied to head side hydraulic sensor 32 and rod side hydraulic sensor 33 through the operation of power switch 35, it is determined that derricking cylinder 15 is assembled to swivel base 7 and derricking cylinder 15's poor connection determination control and protection control are started. In crane 1, the connection state of other side joint 16B, which provides a connection between rod side oil chamber 15F and derricking direct-acting selector valve 28, is determined according to the states of hydraulic pressure Pr of rod side oil chamber 15F and hydraulic pressure Ph of head side oil chamber 15E in derricking cylinder 15. In this case, in crane 1, derricking direct-acting selector valve 28 is controlled such that hydraulic fluid supplied to derricking cylinder 15 is less than or equal to predetermined value F. The increase rates of hydraulic pressure Pr of rod side oil chamber 15F and hydraulic pressure Ph of head side oil chamber 15E in derricking cylinder 15 are suppressed, thereby preventing the application of an excessive hydraulic pressure to derricking cylinder 15 due to the operation by the operator. In crane 1, when it is determined that other side joint 16B providing a connection between rod side oil chamber 15F of derricking cylinder 15 and derricking direct-acting selector valve 28 is not properly connected, derricking direct-acting selector valve 28 is controlled such that the supply of hydraulic fluid to derricking cylinder 15 is forcibly stopped. Further, in crane 1, the operator is informed of the fact that derricking direct-acting selector valve 28 between derricking cylinder 15 and derricking hydraulic circuit 24 is not properly connected. Thus, the actuation of derricking cylinder 15 in poor connection with derricking hydraulic circuit 24 is suppressed, thereby properly protecting derricking cylinder 15.

Although the above-described crane 1, which is one embodiment of crane 1, has a configuration including main winch 17 and sub-winch 18, this is not necessarily the case, and it is only required that derricking cylinder 15 is configured to be detachable from vehicle 2. Further, it is applicable to any hydraulic cylinder that is configured to be detachable from crane 1. The above-described embodiment is mere illustration of a representative mode, and various modifications can be implemented without departing from the spirit of one embodiment. It is natural that it can be implemented in various other modes, the scope of the present invention is indicated by Claims, and equivalents and all modifications of the Claims should be included in the scope of the present invention.

INDUSTRIAL APPLICABILITY

The present invention is applicable to a crane.

REFERENCE SIGNS LIST

1 Crane
15 Derricking cylinder

15E Head side oil chamber
15F Rod side oil chamber
22B Derricking operation tool
23 Safety apparatus
28 Derricking direct-acting selector valve
32 Head side hydraulic sensor
33 Rod side hydraulic sensor
Ph Hydraulic pressure in head side oil chamber
Pr Hydraulic pressure in rod side oil chamber
23 Safety apparatus

The invention claimed is:

1. A crane, comprising:

a crane apparatus;

a detachable hydraulic cylinder to operate the crane apparatus;

a hydraulic circuit configured to supply hydraulic fluid to the hydraulic cylinder, wherein the hydraulic cylinder includes:

a head side oil chamber;

a rod side oil chamber;

oil passages;

joints configured to connect both of the head side oil chamber and the rod side oil chamber to the oil passages;

a control valve configured to be connected to the hydraulic cylinder through the joints;

a head side hydraulic detecting section configured to detect a head side hydraulic pressure of the head side oil chamber; and a rod side hydraulic detecting section configured to detect a rod side hydraulic pressure of the rod side oil chamber; and a control device configured to determine a connection state between the hydraulic cylinder and the control valve based on the head side hydraulic pressure and the rod side hydraulic pressure in a period until a predetermined time elapses after power supply to the head side hydraulic detecting section and the rod side hydraulic detecting section and hydraulic fluid supply to the hydraulic cylinder are started, wherein when the power supply to the head side hydraulic detecting section and the rod side hydraulic detecting section and the hydraulic fluid supply to the hydraulic cylinder are started, the control device limits the behavior of the control valve such that the amount of hydraulic fluid supplied to the hydraulic cylinder is less than or equal to a predetermined value by the time when the predetermined time elapses regardless of the amount of operation of a operation tool for hydraulic cylinder.

2. The crane according to claims 1, further comprising:

an informing section, wherein when it is determined that the hydraulic cylinder and the control valve are not connected to each other, the informing section informs of a poor connection between the hydraulic cylinder and the control valve.

3. The crane according to claim 1, wherein when it is determined that the hydraulic cylinder and the control valve are not connected to each other, the control device switches the control valve to a state of not supplying hydraulic fluid to hydraulic cylinder.

4. The crane according to claim 1, wherein when the rod side hydraulic pressure becomes greater than or equal to the head side hydraulic pressure by the time when the predetermined time elapses, the control device determines that the rod side oil chamber and the control valve are not connected to each other through one of the joints.

* * * * *